US009626891B2

(12) United States Patent
Lee et al.

(10) Patent No.: US 9,626,891 B2
(45) Date of Patent: Apr. 18, 2017

(54) STRETCHABLE DISPLAY PANEL AND DISPLAY DEVICE HAVING THE SAME

(71) Applicant: Samsung Display Co., Ltd., Yongin, Gyeonggi-do (KR)

(72) Inventors: Seung-Jae Lee, Anyang-si (KR); Tae-Jin Kim, Hwaseong-si (KR); Ah-Young Son, Seoul (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 57 days.

(21) Appl. No.: 14/601,958

(22) Filed: Jan. 21, 2015

(65) Prior Publication Data

US 2016/0055783 A1 Feb. 25, 2016

(30) Foreign Application Priority Data

Aug. 20, 2014 (KR) ..... 10-2014-0108250

(51) Int. Cl.
*G09G 3/20* (2006.01)

(52) U.S. Cl.
CPC ... *G09G 3/2003* (2013.01); *G09G 2300/0426* (2013.01); *G09G 2340/0414* (2013.01); *G09G 2340/0421* (2013.01); *G09G 2380/02* (2013.01)

(58) Field of Classification Search
CPC . G09G 2380/02; G06F 1/1652; G06F 1/1616; H05K 1/118; G02F 1/136286; G02F 2201/122; H01L 27/124; H01L 29/78603; H01L 27/0207
USPC ..... 349/139, 150; 345/1.3, 3.3
See application file for complete search history.

(56) References Cited

U.S. PATENT DOCUMENTS 7,564,436 B2 * 7/2009 Huitema ..... G09G 3/3611 345/76
2004/0222943 A1 * 11/2004 Kudo ..... G06F 3/147 345/1.1
2007/0019143 A1 * 1/2007 Chen ..... G02F 1/136286 349/139
2009/0322649 A1 * 12/2009 Hamer ..... G09G 3/20 345/1.3
2010/0002402 A1 1/2010 Rogers et al.
(Continued)

FOREIGN PATENT DOCUMENTS

KR 10-0990315 B1 10/2010
KR 10-2014-0043244 A 4/2014

*Primary Examiner* — Amare Mengistu
*Assistant Examiner* — Gloryvid Figueroa-Gibson
(74) *Attorney, Agent, or Firm* — Knobbe, Martens, Olson & Bear, LLP

(57) ABSTRACT

A stretchable display panel and display device having the same are disclosed. In one aspect, the display panel includes a plurality of first signal lines and a plurality of pixels configured to receive a first signal through the first signal lines. The pixels are divided into a plurality of pixel groups each including a first pixel and second pixel that are adjacent to each other. Each of the first signal lines that are connected to the same pixel group are configured to be electrically connected to each other when the distance between the first and second pixels is less than or equal to a predetermined reference value. Each of the first signal lines that are connected to the same pixel group are further configured to be electrically insulated from each other when the distance between the first and second pixels is greater than the predetermined reference value.

20 Claims, 7 Drawing Sheets

(56) References Cited

U.S. PATENT DOCUMENTS

| | | | | |
|---|---|---|---|---|
| 2011/0275270 | A1* | 11/2011 | Matsuoka | G02F 1/1345 445/2 |
| 2012/0206421 | A1* | 8/2012 | Cok | G09G 3/2085 345/204 |
| 2013/0063048 | A1* | 3/2013 | Matthies | G02F 1/13439 315/312 |
| 2014/0340363 | A1* | 11/2014 | Ikeda | G06F 3/042 345/175 |

* cited by examiner

STRETCHABLE DISPLAY PANEL AND DISPLAY DEVICE HAVING THE SAME

CROSS-REFERENCE TO RELATED APPLICATIONS

This application claims priority from and the benefit of Korean Patent Applications No. 10-2014-0108250, filed on Aug. 20, 2014 in the Korean Intellectual Property Office (KIPO), the disclosure of which is hereby incorporated by reference herein in its entirety.

BACKGROUND

Field

The described technology generally relates to stretchable display panels and display devices having the same.

Description of the Related Technology

Display devices include a display panel having a plurality of pixels. Display devices output images by causing the pixels to emit light.

To meet the manufacturing requirements of dynamic displays such as flexible displays, stretchable displays, transparent displays, etc., research and development is being actively conducted.

SUMMARY OF CERTAIN INVENTIVE ASPECTS

One inventive aspect is a stretchable display panel that can maintain its pixel density and prevent a displayed image from distorting when the display panel is stretched.

Another aspect is a display device having the stretchable display panel.

Another aspect is a stretchable display panel comprising a plurality of pixels configured to receive a first signal through a plurality of first signal applying lines. First pixels and second pixels among the pixels may be adjacent to each other in a first direction that is substantially perpendicular to the first signal applying lines. One of the first signal applying lines that is connected to the first pixels and one of the first signal applying lines that is connected to the second pixels may be electrically coupled to each other when a distance between the first pixels and the second pixels is shorter than or equal to a predetermined reference value. The one of the first signal applying lines that is connected to the first pixels and the one of the first signal applying lines that is connected to the second pixels may be electrically separated from each other when the distance between the first pixels and the second pixels is longer than the predetermined reference value.

In example embodiments, each of the pixels may include a plurality of sub-pixels each outputting a monochromatic light.

In example embodiments, the sub-pixels may be adjacent to each other in a second direction that is substantially perpendicular to the first direction.

In example embodiments, the sub-pixels may include at least one selected from the following a red sub-pixel that emits red light, a green sub-pixel that emits green light, and a blue sub-pixel that emits blue light.

In example embodiments, the sub-pixels may include at least one selected from the following a red sub-pixel that emits red light, a green sub-pixel that emits green light, a blue sub-pixel that emits blue light, and a white sub-pixel that emits white light.

In example embodiments, the pixels may receive a second signal through a plurality of second signal applying lines.

In example embodiments, a length of each of the second signal applying lines may be longer than or equal to a maximum stretchable length of the stretchable display panel in the first direction.

In example embodiments, the second signal applying lines may be stretchable.

In example embodiments, a maximum stretchable length of each of the second signal applying lines may be longer than or equal to a maximum stretchable length of the stretchable display panel in the first direction.

In example embodiments, the first pixels and the second pixels may be commonly driven when the distance between the first pixels and the second pixels is shorter than or equal to the predetermined reference value. The first pixels and the second pixels may be independently driven when the distance between the first pixels and the second pixels is longer than the predetermined reference value.

In example embodiments, the first signal applied to the first pixels may be substantially the same as the first signal applied to the second pixels when the distance between the first pixels and the second pixels is shorter than or equal to the predetermined reference value. The first signal applied to the first pixels may be different from the first signal applied to the second pixels when the distance between the first pixels and the second pixels is longer than the predetermined reference value.

In example embodiments, the first signal may be a scan signal.

In example embodiments, a data signal applied to the first pixels during an active period of the scan signal may be substantially the same as a data signal applied to the second pixels during the active period when the distance between the first pixels and the second pixels is shorter than or equal to the predetermined reference value. The data signal applied to the first pixels during the active period may be different from the data signal applied to the second pixels during the active period when the distance between the first pixels and the second pixels is longer than the predetermined reference value.

In example embodiments, the first signal may be a data signal.

In example embodiments, a data signal applied to the first pixels during an active period of the scan signal may be substantially the same as a data signal applied to the second pixels during the active period when the distance between the first pixels and the second pixels is shorter than or equal to the predetermined reference value. The data signal applied to the first pixels during the active period may be different from the data signal applied to the second pixels during the active period when the distance between the first pixels and the second pixels is longer than the reference value.

Another aspect is a display device comprising a stretchable display panel including a plurality of pixels that receive a scan signal through a plurality of scan lines and that receive a data signal through a plurality of data lines, a scan driver configured to generate the scan signal, a data driver configured to generate the data signal, and a timing controller configured to control the scan driver and the data driver. First pixels and second pixels among the pixels may be adjacent to each other in a first direction that is substantially perpendicular to the scan lines. A first scan line in the scan lines that is connected to the first pixels and a second scan line in the scan lines that is connected to the second pixels may be electrically coupled to each other when a distance between the first pixels and the second pixels is shorter than or equal to a predetermined reference value. The first scan line and the second scan line may be electrically separated from each other when the distance between the first pixels and the second pixels is longer than the predetermined reference value.

In example embodiments, each of the pixels may include a plurality of sub-pixels each outputting a monochromatic light.

In example embodiments, the first pixels and the second pixels may be dependently driven when the distance between the first pixels and the second pixels is shorter than or equal to the predetermined reference value. The first pixels and the second pixels may be independently driven when the distance between the first pixels and the second pixels is longer than the reference value.

In example embodiments, the scan signal applied to the first pixels may be substantially the same as the scan signal applied to the second pixels when the distance between the first pixels and the second pixels is shorter than or equal to the predetermined reference value. The scan signal applied to the first pixels may be different from the scan signal applied to the second pixels when the distance between the first pixels and the second pixels is longer than the predetermined reference value.

In example embodiments, the data signal applied to the first pixels during an active period of the scan signal may be substantially the same as the data signal applied to the second pixels during the active period when the distance between the first pixels and the second pixels is shorter than or equal to the reference value. The data signal applied to the first pixels during the active period may be different from the data signal applied to the second pixels during the active period when the distance between the first pixels and the second pixels is longer than the reference value.

Another aspect is a stretchable display panel comprising a plurality of first signal lines; and a plurality of pixels configured to receive a first signal through the first signal lines, wherein the pixels include a plurality of pixel groups each including a first pixel and second pixel, wherein the first pixel of each pixel group is adjacent to the corresponding second pixel in a first direction that is substantially perpendicular to the first signal lines, wherein the first pixel of each pixel group is connected to one of the first signal lines and the second pixel of each pixel group is connected to another one of the first signal lines, wherein each of the first signal lines that are connected to the same pixel group are configured to be electrically connected to each other when the distance between the first pixel and the second pixel of the corresponding pixel group is less than or equal to a predetermined reference value, and wherein each of the first signal lines that are connected to the same pixel group are further configured to be electrically insulated from each other when the distance between the first pixel and the second pixel of the corresponding pixel group is greater than the predetermined reference value.

In example embodiments, each of the pixels includes a plurality of sub-pixels each configured to output monochromatic light. The sub-pixels can be adjacent to each other in a second direction that is substantially perpendicular to the first direction. The sub-pixels can include at least one of the following: a red sub-pixel configured to emit red light, a green sub-pixel configured to emit green light, and a blue sub-pixel configured to emit blue light. The sub-pixels can include at least one of the following: a red sub-pixel configured to emit red light, a green sub-pixel configured to emit green light, a blue sub-pixel configured to emit blue light, and a white sub-pixel configured to emit white light.

In example embodiments, the pixels are further configured to receive a second signal through a plurality of second signal lines. The length of each of the second signal lines can be greater than or equal to a maximum stretchable length of the stretchable display panel in the first direction. The second signal lines can be stretchable. A maximum stretchable length of each of the second signal lines can be greater than or equal to a maximum stretchable length of the stretchable display panel in the first direction. The first pixel and the second pixel of the same pixel group can be configured to be commonly driven when the distance between the first pixel and the second pixel is less than or equal to the predetermined reference value and the first pixel and the second pixel of the same pixel group can be configured to be independently driven when the distance between the first pixel and the second pixel is greater than the predetermined reference value.

In example embodiments, the first pixel of each pixel group is configured to receive a first signal that is substantially the same as the first signal applied to the second pixel of the corresponding pixel group when the distance between the first and second pixels is less than or equal to the predetermined reference value and wherein the first pixel of each pixel group is further configured to receive a first signal that is different from the first signal applied to the second pixel of the corresponding pixel group when the distance between the first and second pixels is greater than the predetermined reference value. The first signal can be a scan signal.

In example embodiments, the first pixel of each pixel group is further configured to receive a data signal during an active period of the scan signal that is substantially the same as a data signal applied to the second pixel of the same pixel group during the active period when the distance between the first and second pixels is less than or equal to the predetermined reference value and wherein the first pixel of each pixel group is further configured to receive a data signal during the active period that is different from the data signal applied to the second pixel of the same pixel group during the active period when the distance between the first and second pixels is greater than the predetermined reference value. The first signal can be a data signal.

In example embodiments, the first pixel of each pixel group is further configured to receive a data signal during an active period of the scan signal that is substantially the same as a data signal applied to the second pixel of the same pixel group during the active period when the distance between the first and second pixels is less than or equal to the predetermined reference value and wherein the first pixel of each pixel group is further configured to receive a data signal during the active period that is different from the data signal applied to the second pixel of the same pixel group during the active period when the distance between the first and second pixels is greater than the reference value.

Another aspect is a display device comprising a stretchable display panel including: i) a plurality of scan lines, ii) a plurality of data lines, and iii) a plurality of pixels configured to receive a scan signal through the scan lines and a data signal through the data lines; a scan driver configured to generate the scan signal; a data driver configured to generate the data signal; and a timing controller configured to control the scan driver and the data driver, wherein the pixels are divided into a plurality of pixel groups each including a first pixel and a second pixel that are adjacent to each other in a first direction that is substantially perpendicular to the scan lines, wherein a first scan line that is connected the first pixel of a first pixel group and a second scan line that is connected to the second pixel of the first pixel group are electrically connected to each other when the distance between the first and second pixels of the first pixel group is less than or equal to a predetermined reference value, and wherein the first and second scan lines are electrically insulated from each other when the distance between the first and second pixels of the first pixel group is greater than the predetermined reference value.

In example embodiments, each of the pixels includes a plurality of sub-pixels each configured to output monochromatic light. The first and second pixels of the first pixel group can be commonly driven when the distance between the first and second pixels of the first pixel group is less than or equal to the predetermined reference value and the first and second pixels of the first pixel group can be independently driven when the distance between the first and second pixels of the first pixel group is greater than the reference value.

In example embodiments, the scan signal applied to the first pixel of the first pixel group is substantially the same as the scan signal applied to the second pixel of the first pixel group when the distance between the first and second pixels of the first pixel group is less than or equal to the predetermined reference value and wherein the scan signal applied to the first pixel of the first pixel group is different from the scan signal applied to the second pixel of the first pixel group when the distance between the first and second pixels of the first pixel group is greater than the predetermined reference value.

In example embodiments, the data signal applied to the first pixel of the first pixel group during an active period of the scan signal is substantially the same as the data signal applied to the second pixel of the first pixel group during the active period when the distance between the first and second pixels of the first pixel group is less than or equal to the reference value and wherein the data signal applied to the first pixel of the first pixel group during the active period is different from the data signal applied to the second pixel of the first pixel group during the active period when the distance between the first and second pixels is greater than the reference value.

Therefore, the stretchable display panel according to at least one embodiment can alter the electric connection between the signal applying lines (e.g., between the scan lines or between the data lines) based on the distance between the first pixels and the second pixels, so that pixel density (i.e., Pixels Per Inch; PPI) is substantially uniformly maintained when the stretchable display panel is stretched. Thus, distortions of displayed images caused by stretching can be reduced (or minimized).

In addition, the display device according to at least one embodiment includes the stretchable display panel that alters the electric connection between the signal applying lines (e.g., between the scan lines or between the data lines) based on the distance between the first pixels and the second pixels such that usability and visibility of the display device, such as wearable devices, increases.

BRIEF DESCRIPTION OF THE DRAWINGS

Example embodiments can be understood in more detail from the following description taken in conjunction with the accompanying drawings.

DETAILED DESCRIPTION OF CERTAIN INVENTIVE EMBODIMENTS

One type of dynamic display being developed is a stretchable display panel. Generally, the distance (or space) between pixels of stretchable display panels increases as the stretchable display panel is stretched and the distance (or space) between pixels of the stretchable display panels decreases as the stretchable display panel is compressed. Thus, the pixel density, i.e., pixels per inch; PPI, of the stretched portions decreases when the panel is stretched. Further, a displayed image is distorted in a stretched configuration.

Exemplary embodiments will be described more fully hereinafter with reference to the accompanying drawings, in which various embodiments are shown.

Figure 1:
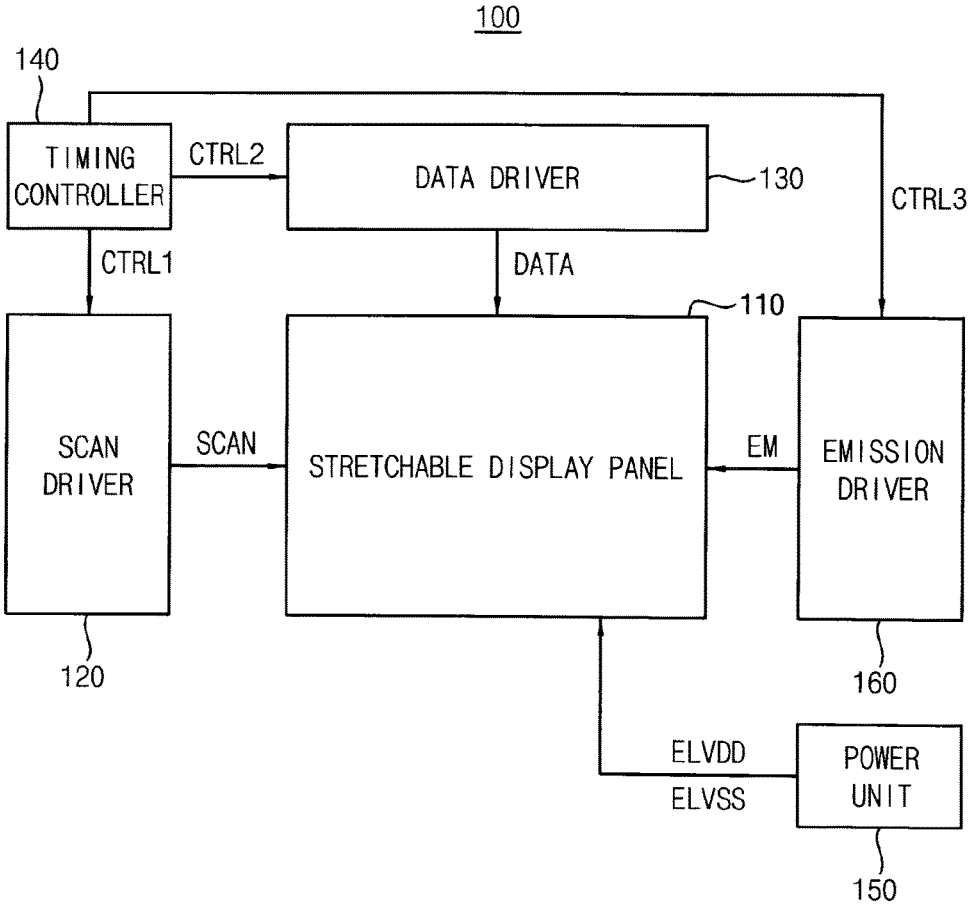
FIG. 1 is a block diagram of a display device according to example embodiments.

FIG. 1 is a block diagram of a display device according to example embodiments.

Referring to FIG. 1, the display device 100 includes a stretchable display panel 110, a scan driver 120, a data driver 130, and a timing controller 140. In one example embodiment, the display device 100 further includes a power unit or power supply 150 and an emission driver 160.

The stretchable display panel 110 includes a plurality of pixels configured to receive a first signal through a plurality of first signal applying lines (or first signal lines).

First pixels and second pixels among the pixels may be adjacent to each other in a first direction that is substantially perpendicular to the first signal applying lines. One of the first signal applying lines that is connected to the first pixels and one of the first signal applying lines that is connected to the second pixels may be electrically coupled to each other when the distance between the first pixels and the second pixels is less than or equal to a predetermined reference value. The one of the first signal applying lines that is connected to the first pixels and the one of the first signal applying lines that is connected to the second pixels may be electrically separated from each other when the distance between the first pixels and the second pixels is greater than the predetermined reference value. In one example embodiment, the first signal applying lines correspond to a plurality of scan lines. In another example embodiment, the first signal applying lines correspond to a plurality of data lines.

According to example embodiments, the first signal applied to the first pixels is substantially the same as the first signal applied to the second pixels when the distance between the first pixels and the second pixels is less than or equal to the predetermined reference value. The first signal applied to the first pixels is different from the first signal applied to the second pixels when the distance between the first pixels and the second pixels is greater than the predetermined reference value. As a result, the first pixels and the second pixels are dependently or commonly driven (i.e. driven with the same signal) when the distance between the first pixels and the second pixels is less than or equal to the predetermined reference value and are independently driven when the distance between the first pixels and the second pixels is greater than the predetermined reference value.

In general, the stretchable display panel 110 includes a plurality of pixels that receive a scan signal SCAN through a plurality of scan lines and a data signal DATA through a plurality of data lines. Here, the pixels receive the data signal generated at the data driver 130 during an active period of the scan signal SCAN. The pixels emit light based on the data signal DATA. In one example embodiment, the pixels emit light based on the data signal DATA during an active period of an emission signal EM.

In one example embodiment, the first signal is the scan signal SCAN. In this embodiment, the first and second pixels respectively receive the scan signals SCAN each having the same active period when the distance between the first pixels and the second pixels is less than or equal to the predetermined reference value, so that the first pixels and the second pixels receive substantially the same data signal DATA. In contrast, the data signal applied to the first pixels during the active period is different from the data signal applied to the second pixels during the active period when the distance between the first pixels and the second pixels is greater than the predetermined reference value. As a result, the first pixels and the second pixels emit light with substantially the same luminance based on substantially the same data signal DATA when the distance between the first pixels and the second pixels is less than or equal to the predetermined reference value. The first pixels and the second pixels emit light with different luminances based on the different data signals DATA when the distance between the first pixels and the second pixels is longer than the predetermined reference value.

In another example embodiment, the first signal is the data signal DATA. In this embodiment, the data signal DATA applied to the first pixels during an active period of the scan signal is substantially the same as the data signal DATA applied to the second pixels during the active period when the distance between the first pixels and the second pixels is less than or equal to the predetermined reference value. In contrast, the data signal applied to the first pixels during the active period is different from the data signal applied to the second pixels during the active period when the distance between the first pixels and the second pixels is greater than the predetermined reference value. As a result, the first pixels and the second pixels emit light with substantially the same luminance based on substantially the same data signal DATA when the distance between the first pixels and the second pixels is less than or equal to the predetermined reference value. The first pixels and the second pixels emit light with different luminances based on the different data signals DATA when the distance between the first pixels and the second pixels is longer than the predetermined reference value.

According to example embodiment, each of the pixels includes a plurality of sub-pixels each outputting monochromatic light. In this embodiment, the sub-pixels are adjacent to each other in a second direction that is substantially perpendicular to the first direction. In one example embodiment, the sub-pixels include at least one of a red sub-pixel that emits red light, a green sub-pixel that emits green light, and a blue sub-pixel that emits blue light. In another example embodiment, the sub-pixels include at least one of a red sub-pixel that emits red light, a green sub-pixel that emits green light, a blue sub-pixel that emits blue light, and a white sub-pixel that emits white light.

In some embodiments, the pixels receive a second signal through a plurality of second signal applying lines (or second signal lines). The length of each of the second signal applying lines is greater than or equal to a maximum stretchable length of the stretchable display panel 110 in the first direction. In one example embodiment, the second signal applying lines are stretchable (i.e., tensile lines).

The scan driver 120 generates the scan signal SCAN. The scan driver 120 can adjust the active period of the scan signal SCAN and an inactive period of the scan signal SCAN. The scan signal SCAN is applied to the pixels through the scan lines.

The data driver 130 generates the data signal DATA. The data driver 130 generates the data signal DATA for a target pixel in which the data signal DATA is applied within the active period of the scan signal SCAN. The data signal DATA is applied to the pixels through the data lines.

The timing controller 140 controls the scan driver 120 and the data driver 130. In one example embodiment, the timing controller 140 controls the emission driver 160. The timing controller 140 controls the scan driver 120 based on a first control signal CTRL1. The timing controlled 140 controls the data driver 130 based on a second control signal CTRL2. The timing controller 140 controls the emission driver 160 based on a third control signal CTRL3.

The power unit 150 supplies a first power voltage ELVDD and a second power voltage ELVSS to the stretchable display panel 110. The power unit 150 respectively supply power voltages to the scan driver 120, the data driver 130, the timing controller 140, and the emission driver 160.

The emission driver 160 generates the emission signal EM. The pixels emit light based on the data signal DATA during the active period of the emission signal EM.

In some embodiments, the electrical connection between the signal applying lines (e.g., between the scan lines or between the data lines) in the stretchable display panel 110 and the display device 100 having the same are adjusted based on the distance between the first pixels and the second pixels, so that the pixel density (i.e., Pixels Per Inch; PPI) is substantially uniformly maintained when the stretchable display panel 110 is stretched. Thus, distortions to displayed images generated when the stretchable display panel 110 is stretched can be reduced (or improved).

Figure 2:
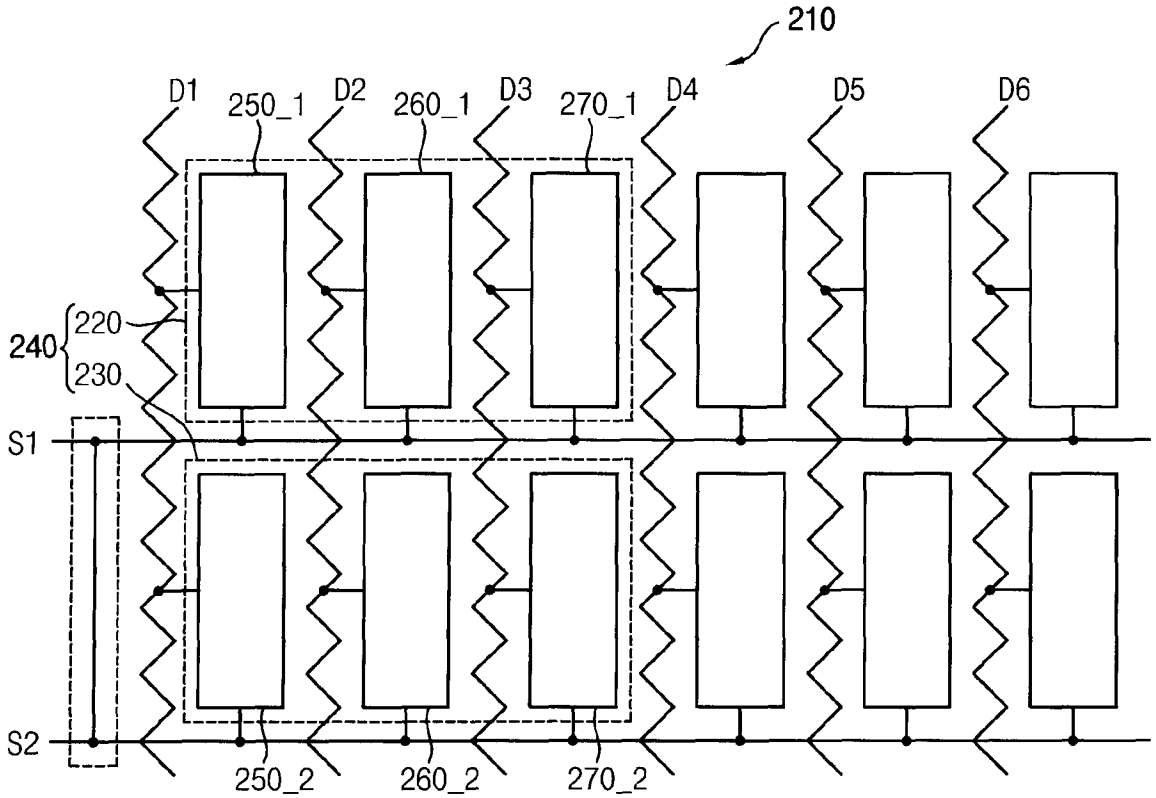
FIG. 2 is a diagram illustrating a stretchable display panel included in the display device of FIG. 1.

FIG. 2 is a diagram illustrating a stretchable display panel included in the display device of FIG. 1.

Referring to FIG. 2, the stretchable display panel 210 includes a first pixel 220 that receives a first scan signal through a first scan line S1 and a second pixel 230 that receives a second scan signal through a second scan line S2. The first pixel 220 includes a first red sub-pixel 250-1 that emits red light, a first green sub-pixel 260-1 that emits green light, and a first blue sub-pixel 270-1 that emits blue light. The second pixel 230 includes a second red sub-pixel 250-2 that emits red light, a second green sub-pixel 260-2 that emits green light, and a second blue sub-pixel 270-2 that emits blue light.

The first and second pixels 220 and 230 are adjacent to each other in a first direction that is substantially perpendicular to the first and second scan lines S1 and S2. The first red, green, and blue sub-pixels 250-1, 260-1, and 270-1 are adjacent to each other in a second direction that is substantially perpendicular to the first direction.

The first pixel 220 and the second pixel 230 form a pixel group 240. The first scan line S1 connected to the first pixel 220 and the second scan line S2 connected to the second pixel 230 are electrically to each other when the distance between the first pixel 220 and the second pixel 230 is less than or equal to a predetermined reference value.

In one example embodiment, the first and second pixels 220 and 230 receive data signals through a first data line D1, a second data line D2, and a third data line D3. The length of each of the data lines D1 to D6 is greater than or equal to a maximum stretchable length of the stretchable display panel 210 in the first direction. In the FIG. 2 embodiment, the data lines have a spring shape when the stretchable display panel 210 is not stretched. For example, the data lines D1 to D6 are stretchable similar to a spring and the maximum stretchable length of each of the data lines D1 to D6 is greater than or equal to the maximum stretchable length of the stretchable display panel 210 in the first direction.

In one example embodiment, the first pixel 220 and the second pixel 230 are dependently driven (i.e. driven with the same signals) when the distance between the first pixel 220 and the second pixel 230 is less than or equal to the predetermined reference value. For example, the first pixel 220 and the second pixel 230 respectively receive substantially the same scan signal through the first scan line S1 and the second scan line S2 that are electrically connected. That is, the first scan signal and the second scan signal are substantially the same. Thus, the data signal applied to the first pixel 220 during an active period of the scan signal is substantially the same as the data signal applied to the second pixel 230 during the active period. As a result, the first and second pixels 220 and 230 (i.e., the pixel group 240) emits light having substantially the same luminance within the same time period. In other word, the first and second pixels 220 and 230 emit light as one pixel when the distance between the first pixel 220 and the second pixel 230 is less than or equal to the predetermined reference value.

Figure 3:
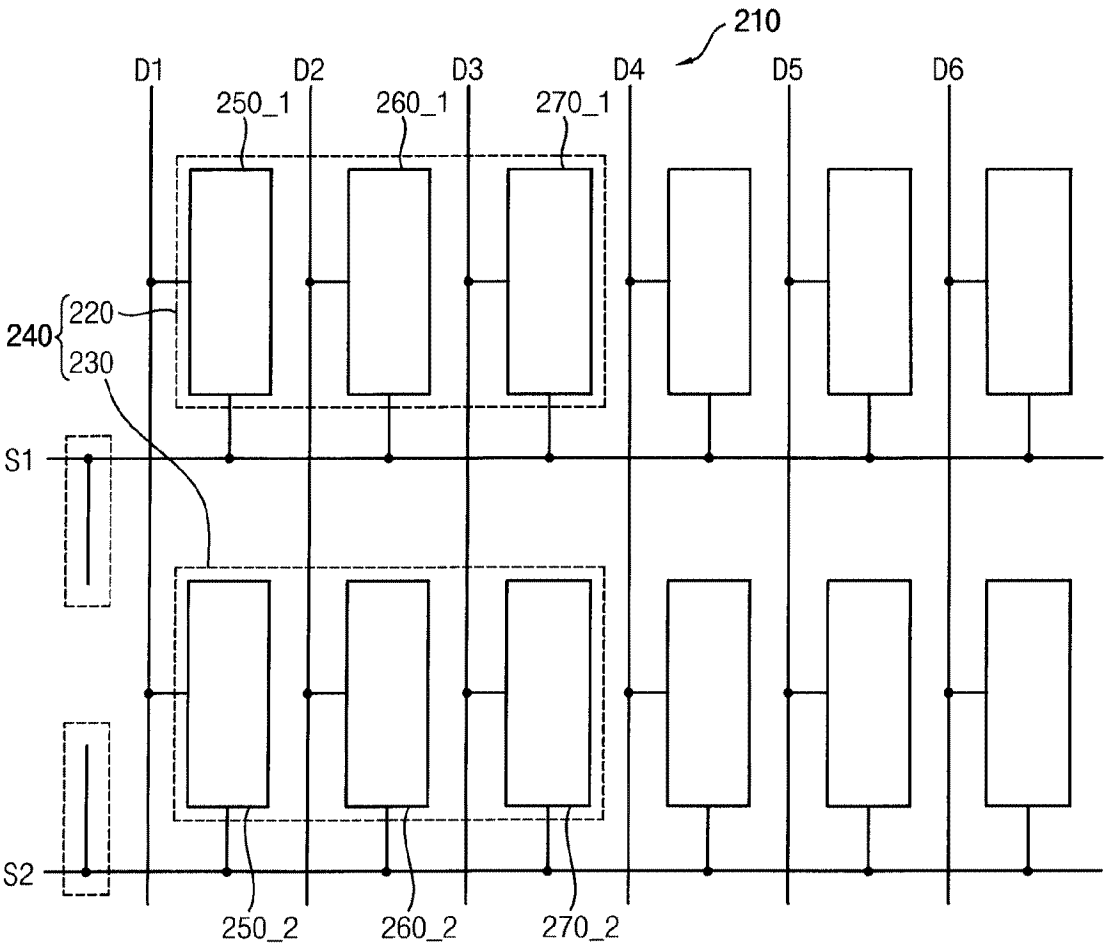
FIG. 3 is a diagram illustrating an example of the stretchable display panel of FIG. 2 being stretched.

FIG. 3 is a diagram illustrating an example of the stretchable display panel of FIG. 2 being stretched.

Referring to FIG. 3, the stretchable display panel 210 includes a first pixel 220 that receives a first scan signal through a first scan line S1 and a second pixel 230 that receives a second scan signal through a second scan line S2. The first pixel 220 includes a first red sub-pixel 250-1 that emits red light, a first green sub-pixel 260-1 that emits green light, and a first blue sub-pixel 270-1 that emits blue light. The second pixel 230 includes a second red sub-pixel 250-2 that emits red light, a second green sub-pixel 260-2 that emits green light, and a second blue sub-pixel 270-2 that emits blue light.

The first pixel 220 and the second pixel 230 form a pixel group 240. The first scan line S1 connected to the first pixel 220 and the second scan line S2 connected to the second pixel 220 are electrically insulated from each other when the distance between the first pixel 220 and the second pixel 230 is greater than a predetermined reference value.

In one example embodiment, the first pixel 220 and the second pixel 230 receive data signals through a first data line D1, a second data line D2, and a third data line D3. The length of each of the data lines D1 to D6 is greater than or equal to a maximum stretchable length of the stretchable display panel 210 in the first direction. Thus, when the stretchable display panel 210 is stretched to its maximum length, the stretchable display panel 210 operates normally. In one example embodiment, the data lines D1 to D6 are stretchable similar to a spring and the maximum stretchable length of each of the data lines D1 to D6 is greater than or equal to the maximum stretchable length of the stretchable display panel 210 in the first direction.

In one example embodiment, the first and second pixels 220 and 230 are independently driven when the distance between the first and second pixels 220 and 230 is greater than the predetermined reference value. For example, the first pixel 220 and the second pixel 230 of FIG. 3 are independently driven. The first pixel 220 and the second pixel 230 respectively receive different scan signals through the first scan line S1 and the second scan line S2 that are electrically separated. That is, the first scan signal and the second scan signal are different. Thus, the data signal applied to the first pixel 220 during an active period of the first scan signal is different from the data signal applied to the second pixel 230 during an active period of the second scan signal. As a result, the first and second pixels 220 and 230 emit light having different luminances within different time periods. However, in other embodiments, the first and second pixels 220 and 230 emit light with different luminances during the same time period.

The electrical connection between the scan lines S1 and S2 is altered based on the distance between the first and second pixels 220 and 230 so that pixel density does not significantly change when the stretchable display panel 210 being stretched. Thus, distortions of the displayed image generated when the stretchable display panel 210 is stretched can be reduced (or improved).

Figure 4:
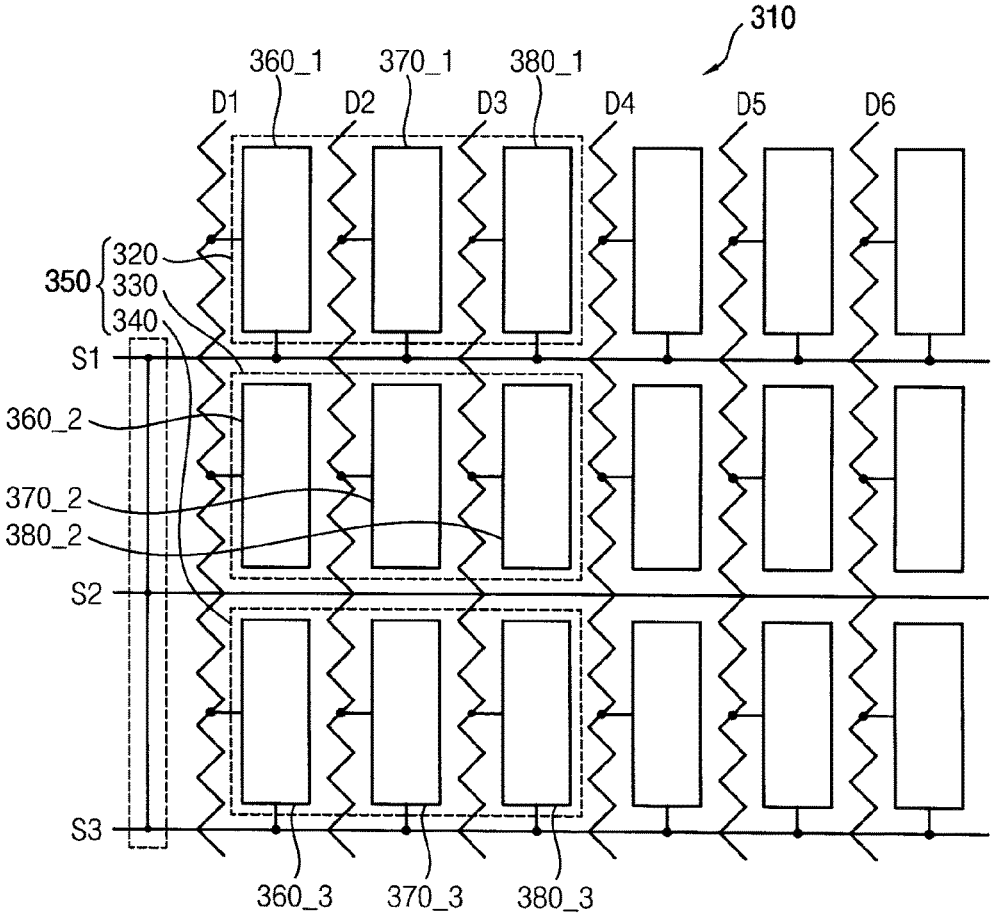
FIG. 4 is a diagram illustrating another example of a stretchable display panel included in the display device of FIG. 1.

FIG. 4 is a diagram illustrating another example of a stretchable display panel included in the display device of FIG. 1.

Referring to FIG. 4, the stretchable display panel 310 includes a first pixel 320 that receives a first scan signal through a first scan line S1, a second pixel 330 that receives a second scan signal through a second scan line S2, and a third pixel 340 that receives a third scan signal through a third scan line S3. The first pixel 320 includes a first red sub-pixel 360-1 that emits red light, a first green sub-pixel 370-1 that emits green light, and a first blue sub-pixel 380-1 that emits blue light. The second pixel 330 includes a second red sub-pixel 360-2 that emits red light, a second green sub-pixel 370-2 that emits green light, and a second blue sub-pixel 380-2 that emits blue light. The third pixel 340 includes a third red sub-pixel 360-3 that emits red light, a third green sub-pixel 370-3 that emits green light, and a third blue sub-pixel 380-3 that emits blue light.

The first pixel 320, the second pixel 330, and the third pixel 340 are adjacent to each other in a first direction that is substantially perpendicular to the first to third scan lines S1 to S3. The first red sub-pixel 360-1, the first green sub-pixel 370-1, and the first blue sub-pixel 380-1 are adjacent to each other in a second direction that is substantially perpendicular to the first direction.

The first to third pixels 320 to 340 form a pixel group 350. The first scan line S1 connected to the first pixel 320 and the second scan line S2 connected to the second pixel are electrically connected to each other when the distance between the first and second pixels 320 and 330 is less than or equal to a predetermined reference value. The second scan line S2 connected to the second pixel 330 and the third scan line S3 connected to the third pixel 340 are electrically connected to each other when the distance between the second pixel 330 and the third pixel 340 is less than or equal to a predetermined reference value.

In one example embodiment, the first to third pixels 320 to 340 respectively receive data signals through a first data line D1, a second data line D2, and a third data line D3. The length of each of the data lines D1 to D6 is greater than or equal to a maximum stretchable length of the stretchable display panel 310 in the first direction. Here, the data lines have a spring shape when the stretchable display panel 310 is not stretched. For example, the data lines D1 to D6 are stretchable similar to a spring type the maximum stretchable length of each of the data lines D1 to D6 is greater than or equal to the maximum stretchable length of the stretchable display panel 310 in the first direction.

In one example embodiment, the first to third pixels 320 to 340 are dependently driven (i.e. driven with the same signals) when the distance between the first pixel 320 and the second pixel 330 and the distance between the second pixel 330 and the third pixel 340 are less than or equal to the predetermined reference value. For example, the first to third pixels 320, 330 and 340 respectively receive substantially the same scan signal through the first to third scan lines S1, S2 and S3 that are electrically connected. That is, the first scan signal, the second scan signal, and the third scan signal are substantially the same. Thus, the data signal applied to the first pixel 320 during an active period of the scan signal is substantially the same as the data signal applied to the second pixel 330 and the data signal applied to the third pixel 340 during the active period. As a result, the first to third pixels 320, 330 and 340 (i.e., the pixel group 350) emit light having substantially the same luminance within the same time period. In other words, the first to third pixels 320, 330 and 304 emit light as one pixel when the distance between the first pixel 320 and the second pixel 330 and the distance between the second pixel 330 and the third pixel 340 are less than or equal to the predetermined reference value.

Figure 5:
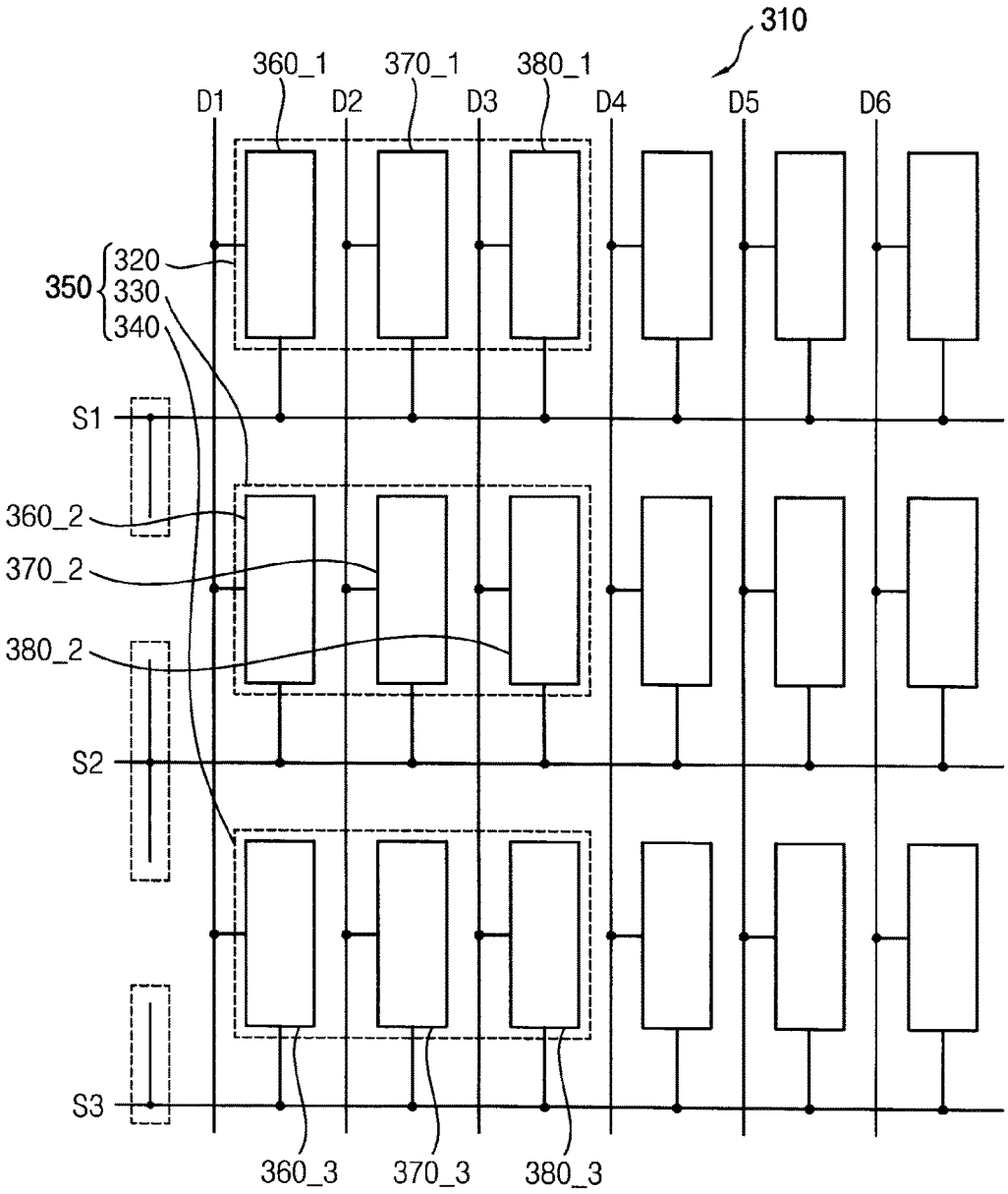
FIG. 5 is a diagram illustrating an example of the stretchable display panel of FIG. 4 being stretched.

FIG. 5 is a diagram illustrating an example of the stretchable display panel of FIG. 4 being stretched.

Referring to FIG. 5, the stretchable display panel 310 include a first pixel 320 that receives a first scan signal through a first scan line S1, a second pixel 330 that receives a second scan signal through a second scan line S2, and a third pixel 340 that receives a third scan signal through a third scan line S3. The first pixel 320 includes a first red sub-pixel 360-1 that emits red light, a first green sub-pixel 370-1 that emits green light, and a first blue sub-pixel 380-1 that emits blue light. The second pixel 330 includes a second red sub-pixel 360-2 that emits red light, a second green sub-pixel 370-2 that emits green light, and a second blue sub-pixel 380-2 that emits blue light. The third pixel 340 includes a third red sub-pixel 360-3 that emits red light, a third green sub-pixel 370-3 that emits green light, and a third blue sub-pixel 380-3 that emits blue light.

The first pixel 320, the second pixel 330, and the third pixel 340 form a pixel group 350. The first scan line S1 connected to the first pixel 320 and the second scan line S2 connected to the second pixel 330 are electrically insulated from each other when the distance between the first pixel 320 and the second pixel 330 is greater than a predetermined reference value. The second scan line S2 connected to the second pixel 330 and the third scan line S3 connected to the third pixel 340 are electrically insulated from each other when the distance between the second pixel 330 and the third pixel 340 is greater than the predetermined reference value.

In one example embodiment, the first to third pixels 320 to 340 respectively receive data signals through a first data line D1, a second data line D2, and a third data line D3. The length of each of the data lines D1 to D6 is greater than or equal to a maximum stretchable length of the stretchable display panel 310 in the first direction. Thus, even if the stretchable display panel 310 is maximally stretched, the stretchable display panel 310 operates normally. Here, the data lines have a spring shape when the stretchable display panel 310 is not stretched. For example, the data lines D1 to D6 are stretchable similar to a spring and the maximum stretchable length of each of the data lines D1 to D6 is greater than or equal to the maximum stretchable length of the stretchable display panel 310 in the first direction.

In one example embodiment, the first to third pixels 320 to 340 are independently driven when the distance between the first pixel 320 and the second pixel 330 and the distance between the second pixel 330 and the third pixel 340 are greater than the predetermined reference value. For example, the first pixel 320, the second pixel 330, and the first pixel 340 of FIG. 5 are independently driven. The first to third pixels 320, 330 and 340 respectively receive different scan signals through the first to third scan lines S1, S2 and S3 that are electrically insulated. That is, the first to third scan signals are different. Thus, the data signal applied to the first pixel 320 during an active period of the first scan signal is different from the data signal applied to the second pixel 330 during an active period of the second scan signal. Similarly, the data signal applied to the second pixel 330 during the active period of the second scan signal is different from the data signal applied to the third pixel 340 during an active period of the third scan signal. As a result, the first to third pixels 320, 330 and 340 emit light each having different luminances due to the data signals received at the different times.

The electrical connections between the scan lines S1 to S3 are altered based on the distances between the first to third pixels 320, 330 and 340, so that the pixel density does not significantly change when the stretchable display panel 310 is stretched. Thus, distortions of the displayed image generated when the stretchable display panel 310 is stretched can be reduced (or improved).

Figure 6:
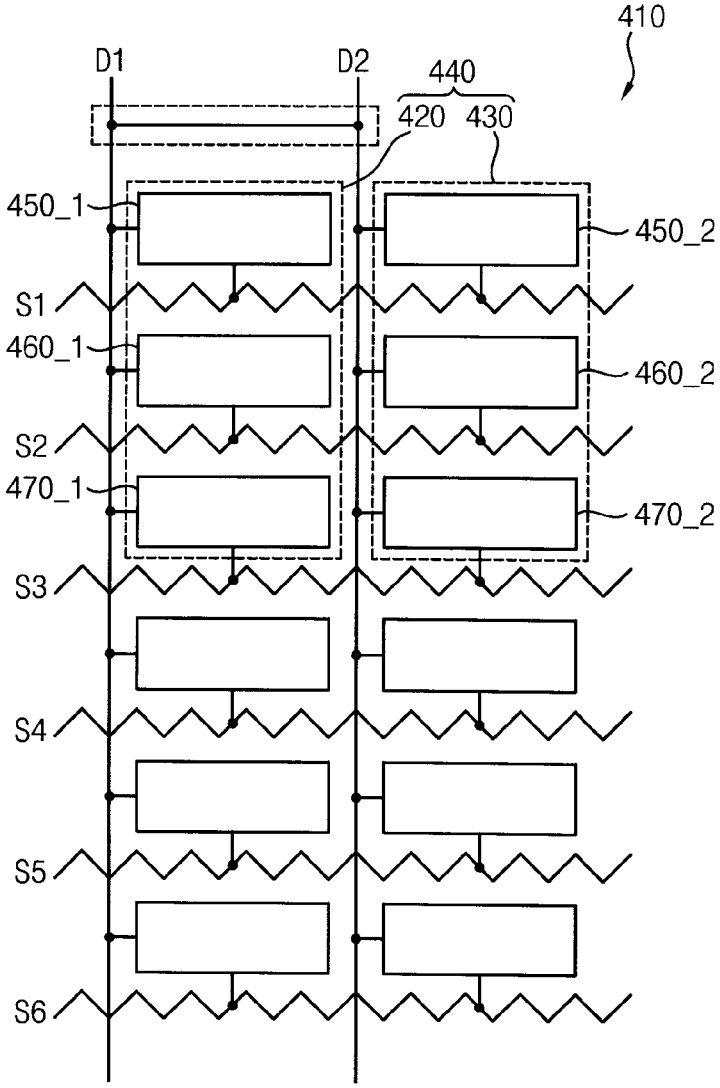
FIG. 6 is a diagram illustrating still another example of a stretchable display panel included in the display device of FIG. 1.

FIG. 6 is a diagram illustrating still another example of a stretchable display panel included in the display device of FIG. 1.

Referring to FIG. 6, the stretchable display panel 410 includes a first pixel 420 that receives a first data signal through a first data line D1 and a second pixel 430 that receives a second data signal through a second data line D2. The first pixel 420 includes a first red sub-pixel 450-1 that emits red light, a first green sub-pixel 460-1 that emits green light, and a first blue sub-pixel 470-1 that emits blue light. The second pixel 430 includes a second red sub-pixel 450-2 that emits red light, a second green sub-pixel 460-2 that emits green light, and a second blue sub-pixel 470-2 that emits blue light.

The first pixel 420 and the second pixel 430 are adjacent to each other in a first direction that is substantially perpendicular to the first and second data lines D1 and D2. The first red sub-pixel 450-1, the first green sub-pixel 460-1, and the first blue sub-pixel 470-1 are adjacent to each other in a second direction that is substantially perpendicular to the first direction.

The first pixel 420 and the second pixel 430 may form a pixel group 440. The first data line D1 connected to the first pixel 420 and the second data line D2 connected to the second pixel 430 are electrically connected to each other when the distance between the first pixel 420 and the second pixel 430 is less than or equal to a predetermined reference value.

In one example embodiment, the first pixel 420 and the second pixel 430 receive scan signals through a first scan line S1, a second scan line S2, and a third scan line S3. The length of each of the scan lines S1 to S6 is greater than or equal to a maximum stretchable length of the stretchable display panel 410 in the first direction. Here, the scan lines have a spring shape when the stretchable display panel 410 is not stretched. For example, the scan lines S1 to S6 are stretchable similar to a spring and a maximum stretchable length of each of the scan lines S1 to S6 is greater than or equal to the maximum stretchable length of the stretchable display panel 410 in the first direction.

In one example embodiment, the first pixel 420 and the second pixel 430 are dependently driven (i.e. driven with the same signals) when the distance between the first pixel 420 and the second pixel 430 is less than or equal to the predetermined reference value. For example, the first and second pixels 420 and 430 respectively receive substantially the same data signals through the first data line D1 and the second data line D2 that are electrically connected. Thus, the data signal applied to the first pixel 420 during an active period of the scan signal is substantially the same as the data signal applied to the second pixel 430 during the active period. As a result, the first and second pixels 420 and 430 (i.e., the pixel group 440) emit light having substantially the same luminance within the same time period. In other word, the first pixel 420 and the second pixel 430 emit light as one pixel when the distance between the first pixel 420 and the second pixel 430 is less than or equal to the predetermined reference value.

Figure 7:
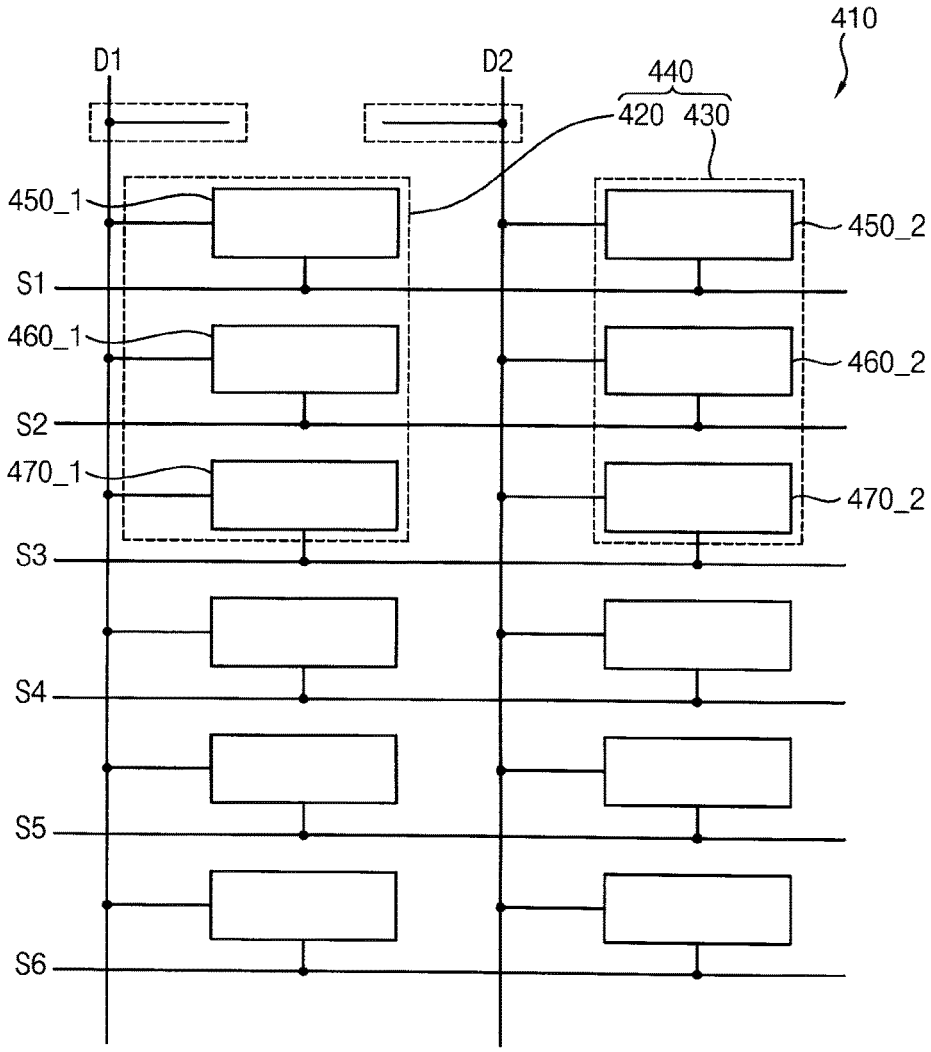
FIG. 7 is a diagram illustrating an example of the stretchable display panel of FIG. 6 being stretched.

FIG. 7 is a diagram illustrating an example of the stretchable display panel of FIG. 6 being stretched.

Referring to FIG. 7, the stretchable display panel 410 includes a first pixel 420 that receives a first data signal through a first data line D1 and a second pixel 430 that receives a second data signal through a second data line D2. The first pixel 420 includes a first red sub-pixel 450-1 that emits red light, a first green sub-pixel 460-1 that emits green light, and a first blue sub-pixel 470-1 that emits blue light. The second pixel 430 includes a second red sub-pixel 450-2 that emits red light, a second green sub-pixel 460-2 that emits green light, and a second blue sub-pixel 470-2 that emits blue light.

The first pixel 420 and the second pixel 430 may form a pixel group 440. The first data line D1 connected to the first pixel 420 and the second data line D2 connected to the second pixel 430 are electrically insulated from each other when the distance between the first pixel 420 and the second pixel 430 is greater than a predetermined reference value.

In one example embodiment, the first pixel 420 and the second pixel 430 receive scan signals through a first scan line S1, a second scan line S2, and a third scan line S3. The length of each of the data lines S1 to S6 is greater than or equal to a maximum stretchable length of the stretchable display panel 410 in the first direction. Thus, when the stretchable display panel 410 is maximally stretched, the stretchable display panel 410 continues to operate normally. In one example embodiment, the scan lines S1 to S6 are stretchable similar to a spring and a maximum stretchable length of each of the scan lines S1 to S6 is greater than or equal to the maximum stretchable length of the stretchable display panel 410 in the first direction.

In one example embodiment, the first pixel 420 and the second pixel 430 are independently driven when the distance between the first pixel 420 and the second pixel 430 is greater than the predetermined reference value. For example, the first pixel 420 and the second pixel 430 of FIG. 7 are independently driven. The first pixel 420 and the second pixel 430 respectively receive different data signals through the first data line D1 and the second data line D2 that are electrically insulated. Thus, the data signal applied to the first pixel 420 during an active period of the scan signal is different from the data signal applied to the second pixel 430 during the active period. As a result, the first and second pixels 420 and 430 emit light each having different luminance within the substantially same time period.

As described above, the electric connections between the data lines D1 and D2 is altered based on the distance between the first pixel 420 and the second pixel 430, so that the pixel density does not significantly change when the stretchable display panel 410 is stretched. Thus, distortions of displayed images generated when the stretchable display panel 410 is stretched can be reduced (or improved).

Although the example embodiments have been described based on a pixel including a red sub-pixel, a green sub-pixel, and a blue sub-pixel, the example embodiments are not limited thereto.

The present embodiments may be applied to any display device and any system including the display device. For example, the present embodiments may be applied to a television, a computer monitor, a laptop, a digital camera, a cellular phone, a smart phone, a smart pad, a personal digital assistant (PDA), a portable multimedia player (PMP), a MP3 player, a navigation system, a game console, a video phone, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The invention is defined by the following claims, with equivalents of the claims to be included therein.

What is claimed is:

1. A stretchable display panel, comprising:

a plurality of first signal lines; and a plurality of pixels configured to receive a plurality of first signals through the first signal lines, wherein the pixels include a plurality of pixel groups each including a first pixel and second pixel, wherein the first pixel of each pixel group is directly adjacent to the corresponding second pixel in a first direction that is substantially perpendicular to the first signal lines, wherein the first pixel of each pixel group is connected to one of the first signal lines and the second pixel of each pixel group is connected to another one of the first signal lines, wherein each of the first signal lines that are connected to the same pixel group are configured to be directly electrically connected to each other when the distance between the first pixel and the second pixel of the corresponding pixel group is less than or equal to a predetermined reference value, and wherein each of the first signal lines that are connected to the same pixel group are further configured to be electrically insulated from each other when the distance between the first pixel and the second pixel of the corresponding pixel group is greater than the predetermined reference value.

2. The panel of claim 1, wherein each of the pixels includes a plurality of sub-pixels each configured to output monochromatic light.

3. The panel of claim 2, wherein the sub-pixels are adjacent to each other in a second direction that is substantially perpendicular to the first direction.

4. The panel of claim 2, wherein the sub-pixels include at least one of the following: a red sub-pixel configured to emit red light, a green sub-pixel configured to emit green light, and a blue sub-pixel configured to emit blue light.

5. The panel of claim 2, wherein the sub-pixels include at least one of the following: a red sub-pixel configured to emit red light, a green sub-pixel configured to emit green light, a blue sub-pixel configured to emit blue light, and a white sub-pixel configured to emit white light.

6. The panel of claim 1, wherein the pixels are further configured to receive a second signal through a plurality of second signal lines.

7. The panel of claim 6, wherein the length of each of the second signal lines is greater than or equal to a maximum stretchable length of the stretchable display panel in the first direction.

8. The panel of claim 6, wherein the second signal lines are stretchable.

9. The panel of claim 8, wherein a maximum stretchable length of each of the second signal lines is greater than or equal to a maximum stretchable length of the stretchable display panel in the first direction.

10. The panel of claim 1, wherein the first pixel and the second pixel of the same pixel group are configured to be commonly driven when the distance between the first pixel and the second pixel is less than or equal to the predetermined reference value and wherein the first pixel and the second pixel of the same pixel group are configured to be independently driven when the distance between the first pixel and the second pixel is greater than the predetermined reference value.

11. The panel of claim 10, wherein the first and second pixels of each pixel group are respectively configured to receive a corresponding one of the first signals, wherein the first signals received by the first and second pixels of each pixel group are substantially the same as each other when the distance between the first and second pixels is less than or equal to the predetermined reference value and wherein the first signals received by the first and second pixels of each pixel group are different from each other when the distance between the first and second pixels is greater than the predetermined reference value.

12. The panel of claim 11, wherein the first signals are scan signals.

13. The panel of claim 12, wherein the first pixel of each pixel group is further configured to receive a first data signal during an active period of a corresponding one of the scan signals that is substantially the same as a second data signal applied to the second pixel of the same pixel group during the active period when the distance between the first and second pixels is less than or equal to the predetermined reference value and wherein the first pixel of each pixel group is further configured to receive the first data signal during the active period that is different from the second data signal applied to the second pixel of the same pixel group during the active period when the distance between the first and second pixels is greater than the predetermined reference value.

14. The panel of claim 11, wherein the first signals are data signals.

15. The panel of claim 14, wherein the first pixel of each pixel group is further configured to receive a first data signal during an active period of a scan signal that is substantially the same as a second data signal applied to the second pixel of the same pixel group during the active period when the distance between the first and second pixels is less than or equal to the predetermined reference value and wherein the first pixel of each pixel group is further configured to receive the first data signal during the active period that is different from the second data signal applied to the second pixel of the same pixel group during the active period when the distance between the first and second pixels is greater than the reference value.

16. A display device, comprising:

a stretchable display panel including: i) a plurality of scan lines, ii) a plurality of data lines, and iii) a plurality of pixels configured to receive a scan signal through the scan lines and a data signal through the data lines;

a scan driver configured to generate the scan signal;

a data driver configured to generate the data signal; and a timing controller configured to control the scan driver and the data driver, wherein the pixels are divided into a plurality of pixel groups each including a first pixel and a second pixel that are directly adjacent to each other in a first direction that is substantially perpendicular to the scan lines, wherein a first scan line that is connected the first pixel of a first pixel group and a second scan line that is connected to the second pixel of the first pixel group are directly electrically connected to each other when the distance between the first and second pixels of the first pixel group is less than or equal to a predetermined reference value, and wherein the first and second scan lines are electrically, insulated from each other when the distance between the first and second pixels of the first pixel group is greater than the predetermined reference value.

17. The device of claim 16, wherein each of the pixels includes a plurality of sub-pixels each configured to output monochromatic light.

18. The device of claim 16, wherein the first and second pixels of the first pixel group are commonly driven when the distance between the first and second pixels of the first pixel group is less than or equal to the predetermined reference value and wherein the first and second pixels of the first pixel group are independently driven when the distance between the first and second pixels of the first pixel group is greater than the reference value.

19. The device of claim 18, wherein the scan signal applied to the first pixel of the first pixel group is substantially the same as the scan signal applied to the second pixel of the first pixel group when the distance between the first and second pixels of the first pixel group is less than or equal to the predetermined reference value and wherein the scan signal applied to the first pixel of the first pixel group is different from the scan signal applied to the second pixel of the first pixel group when the distance between the first and second pixels of the first pixel group is greater than the predetermined reference value.

20. The device of claim 19, wherein the data signal applied to the first pixel of the first pixel group during an active period of the scan signal is substantially the same as the data signal applied to the second pixel of the first pixel group during the active period when the distance between the first and second pixels of the first pixel group is less than or equal to the reference value and wherein the data signal applied to the first pixel of the first pixel group during the active period is different from the data signal applied to the second pixel of the first pixel group during the active period when the distance between the first and second pixels is greater than the reference value.

* * * * *